US005230853A

United States Patent [19]

Colegrove et al.

[11] Patent Number: 5,230,853

[45] Date of Patent: Jul. 27, 1993

[54] PROCESS FOR MAKING POLYSACCHARIDE FIBERS

[75] Inventors: George T. Colegrove; Thomas A. Lindroth, both of San Diego, Calif.

[73] Assignee: Merck & Co., Inc., Rahway, N.J.

[21] Appl. No.: 816,792

[22] Filed: Jan. 3, 1992

Related U.S. Application Data

[63] Continuation of Ser. No. 513,384, Apr. 23, 1990, abandoned.

[51] Int. Cl.[5] ..... D01F 9/00

[52] U.S. Cl. ..... 264/186; 264/211.11

[58] Field of Search ..... 264/186, 211, 211.11

[56] References Cited

U.S. PATENT DOCUMENTS

| | | | |
|---|---|---|---|
| 4,089,981 | 5/1978 | Richardson | 426/601 X |
| 4,143,163 | 3/1979 | Hutchinson et al. | 426/804 X |
| 4,326,052 | 4/1982 | Kang et al. | 536/1 |
| 4,326,053 | 4/1982 | Kang et al. | 536/1 |
| 4,377,636 | 3/1983 | Kang et al. | 435/101 |
| 4,385,126 | 5/1983 | Chen et al. | 436/518 |
| 4,503,084 | 3/1985 | Baird et al. | 426/573 |
| 4,853,168 | 8/1989 | Eden et al. | 264/211.11 X |
| 4,869,916 | 9/1989 | Clark et al. | 426/573 |

FOREIGN PATENT DOCUMENTS

| | | | |
|---|---|---|---|
| 0232121 | 8/1987 | European Pat. Off. . | |
| 58162249 | 9/1983 | Japan | 426/573 |
| 61-239018 | 10/1986 | Japan | 264/186 |
| 0568177 | 3/1945 | United Kingdom . | |
| 0653341 | 5/1951 | United Kingdom . | |

*Primary Examiner*—Leo B. Tentoni

*Attorney, Agent, or Firm*—Richard S. Parr; Gabriel Lopez; Charles M. Caruso

[57] ABSTRACT

Polysaccharide fibers are produced by hot extrusion of a gelling polysaccharide into air or a gelling salt bath. Optionally, other polysaccharides, including non-gelling types, may be co-extruded with the gelling polysaccharide. The fibers are useful for the production of wound dressings and catamenial devices, and many other devices.

2 Claims, No Drawings

PROCESS FOR MAKING POLYSACCHARIDE FIBERS

This is a continuation of application Ser. No. 07/513,384, filed Apr. 23, 1990, now abandoned.

BACKGROUND OF THIS INVENTION

Alginate fibers have been known for use in surgical dressings for some time. UK 653,341 is an example of an early disclosure of the use of calcium alginate materials in surgical dressings. The earliest such materials were calcium alginate fibers, but they suffered from the disadvantage of being quite insoluble in water or wound exudate matter. Later a portion of the calcium ions in calcium alginate was substituted with other cations, whose alginate salts are soluble. UK 653,341 therefore proposed that some of the calcium ions be replaced with sodium ions, to form a mixed salt alginate.

Other uses for alginate fibers have been proposed which involve shaping the fibers as by weaving or knitting into sheets or pads. These materials are useful because they absorb water and swell but retain their shape and structural integrity.

Other polysaccharides have been proposed for fiber formation. For example, Burrow et al. (EP 232,121) have described cross-linked polysaccharides (starch, gellan, curdlan, pullulan, and glycogen) fibers. These cross-linked fibers are produced by extruding a dissolved carboxylate ester of the polysaccharide while simultaneously hydrolyzing the ester groups and cross-linking the resultant hydroxyl groups.

The extrusion of man-made fibers is known. Extrusion processes are known as melt, dry, and wet spinning. In melt spinning the molten polymer is extruded through a spinneret, which is a die perforated with tiny holes. The extruded material is cooled to form the fibers. Spinnerets of various hole sizes and cross-sections are used. Nylon, polyester, olefin and glass fibers are made by this method.

Dry spinning is used for acetate, triacetate, and acrylic fibers. In this process, the polymer is dissolved in an organic solvent and the extruded material is passed through a heated area to evaporate the solvent and form the fiber.

Wet spinning is used for rayon, spandex, and acrylics. In this process the dissolved polymer is extruded into a liquid bath where the fiber is coagulated or precipitated.

Maga et al., Intern'l J. of Food Sci. and Tech., 23, 49–56 (1988) have described the extrusion of various hydrocolloids at concentrations of up to 1% in combination with corn grits.

SUMMARY OF THIS INVENTION

It has now been found that polysaccharide (hereinafter, "gum") fibers may be produced by hot extrusion of a concentrated gum solution into the air or a gelling bath. The process, advantageously, does not require esterification and subsequent hydrolysis, nor the extensive drying required with prior art processes.

DETAILED DESCRIPTION

By the term "gellan gum", as used herein, is meant the extracellularly produced gum made by the heteropolysaccharide-producing bacterium *Pseudomonas elode*, ATCC 31461, by the whole culture fermentation under a variety of conditions of a medium comprising: a fermentable carbohydrate, a nitrogen source, and other appropriate nutrients. Included is the native (i.e., non-deacylated), deacylated, partially deacylated, and clarified forms therefore. Gellan gum is also known as S-60.

Processes for producing gellan gum are well-known in the art, e.g., U.S. Pat. Nos. 4,326,052, 4,326,053, 4,377,636, 4,385,126, and 4,503,084.

The other gums described herein are also all well known and commercially available. These gums can be divided into two groups: thermosetting and non-thermosetting; i.e., gums which form gels on heating (80°–100° C.) and cooling (room temperature—80° C.) and gums which do not. The thermosetting gums may additionally require other specific conditions such as the presence of gelling salts, specific pH ranges, etc. which are known in the art. As used herein, these are gums described as gelling and non-gelling gums.

The gelling gums are gellan, carrageenan, agar, starch, and the combination of xanthan and locust bean gum (lbg).

The non-gelling gums are algin (including its salts (alginates)), galactomannans (specifically, guar and lbg), xanthan, low methoxy pectin, tragacanth, arabic, cellulose (including its derivatives (carboxymethyl-, hydroxyethyl, and methyl-cellulose).

The fibers herein may be formed from 100% gelling gum. Optionally, up to 80% of the gelling gum may be replaced by a non-gelling gum. Additionally, the fibers may contain up to 20% of non-gum material. These material include:

a) pharmaceuticals: e.g., antibiotics, analgesics, etc.;
b) metal ion: e.g., calcium, magnesium, zinc, etc.;
c) food ingredients: e.g., flavors, enzymes, etc:
d) agricultures agents: e.g., pesticides; and
e) industrial agents: e.g., adhesives, deodorants, corrosion inhibitors, etc.

These non-gum materials may be chosen to modify the texture, strength, or other property of the fiber itself; for example, metal ions will cross-link with some gums and change the solubility thereof. Other materials may be chosen because of their activity; for example, magnesium ions would be slowly released from magnesium alginate fibers and act to prevent toxic shock syndrome if the alginate fiber were manufactured into a tampon.

In general, concentrated gelling gum dispersions containing 10–30% gum (percentages herein are on a wt./wt. basis unless stated otherwise) are extruded through fine orifices into the air, into air followed by dipping into a bath, or directly into a bath containing various cations to produce filamentous fibers which can be used in wound dressings, catamenial devices, etc. The bath can last from 5 seconds to 5 minutes, depending on the materials in the bath and their concentration. The dispersions must be extruded hot (i.e., 80°–100° C.).

The orifices can be of various sizes and cross-section. The extruder used herein had a nozzle with eleven-thousandths of an inch holes.

In the process of the invention, a 10–30% gum dispersion in water is prepared as by adding gum powder to the water with agitation, non-gum materials are added to the dispersion, the dispersion is then heated to 80°–100° C. to dissolve the gum, and finally the heated dispersion is extruded into the air or a gelling bath and cooled to less than 80° C. The gelling bath may contain 0.2–5% of an aqueous salt solution wherein the salt cation is chosen because it reacts desirably with at least one of the gums in the extruded material. For example, where one of the gums is sodium alginate, the gelling bath could contain calcium salt, which will replace all or a portion of the sodium cations, thus producing a fiber less soluble then one made solely of sodium alginate. Alternatively, the sodium alginate could be extruded into a magnesium salt bath to produce a fiber containing magnesium alginate.

The gum used may be either a single gelling gum or a combination of gelling gums. Optionally, up to 80% of the gelling gum may be replaced by a non-gelling gum or a combination of non-gelling gums.

The extrusion device can be any of various extruders commercially available. An example of a laboratory-scale device is the Brabender Model 2003, fitted with nozzle having eleven thousandths of an inch holes. Production size devices are also well known, which are used to extrude rayon (regenerated cellulose) and alginate fibers.

When the single gelling gum is co-extruded with other gums, this produces fibers with hybrid properties.

Gellen gum is particularly useful for forming fibers containing magnesium ions as it also gels in the presence of magnesium salts. The gellan gum solution above can be extruded into a bath containing 1-3% magnesium sulfate wherein fiber formation also immediately occurs. Fibers containing a source of magnesium are valuable additives to catamenial devices such as tampons where magnesium ions are said to prevent toxic shock syndrome. Magnesium alginate is soluble in water; therefore it cannot be formed by useful methods but must be formed by ion exchange from insoluble calcium alginate fibers already produced by the usual methods. A small amount can be formed simultaneously with gellan gum fibers however, by incorporating sodium alginate into gellan gum solutions before extrusion into the gelling bath. Up to about 80% sodium alginate based on the weight of the gellan gum is possible without destroying the fiber integrity. Thus, gellan gum plus sodium alginate can be extruded into a bath containing magnesium sulfate wherein gelation and fiber formation immediately occurs. Since the alginate tends to swell slightly the bath may also contain up to 50% of a lower alcohol such as isopropanol to minimize swelling. The same solution can be extruded into a 1-3% calcium chloride bath wherein fiber formation immediately occurs because both polysaccharides gel with calcium ions.

The process of the present invention exhibits various advantages over prior art process:

1) Stronger fibers are produced because of the higher solids content in the fiber. The dilution of highly viscous polymers, which produces weak fibers is therefore avoided.
2) Less energy is required to dry the fibers.
3) The ability to produce fibers containing combinations of gums whether they are themselves thermosetting or not, and which cannot be made by the wet bath process.
4) Water soluble active ingredients are easily incorporated, remain within the fiber, and are not washed out as they may be if extruded into an aqueous bath.
5) Direct incorporation of pharmaceutical agents, flavors, essences, and many other chemicals into the fibers without losses caused by an ion bath.
6) The formation of a wide variety of fibers which can be water soluble, water insoluble, water swellable, thermo-reversible, or non-thermoreversible.
7) Lower costs.
8) Ease of handling.

The fibers of this invention can be used in various forms. If a non-woven fabric is to be prepared, and this is the fabric of choice, a cotton card may be used to form a web, which may then be cross-lapped and then needle punched in conventional equipment.

If a woven fabric is to be prepared, the fibers may be carded and then spun into a yarn, which can be woven in a conventional loom. Alternatively, the fibers may be collected in a spinning box, according to the method of Tallis (UK 568,177) and woven. If a knitted fabric is to be prepared, the fibers can be prepared as a continuous filament yarn (again according to UK 568,177) which is then knitted on a conventional knitting machine.

The fibers have many applications. For example, they can be used as wound dressings, especially ones in which ions or other compounds which promote healing or prevent wound sepsis are easily incorporated.

Fibers containing magnesium may be incorporated with fibers normally used in catamenial devices such as tampons to absorb fluids. The magnesium ion is slowly released and may help prevent toxic shock syndrome.

Medicaments may be entrapped within the fiber. After drying, the fibers may be milled and added to tablets for controlled release of the drug.

Fibers containing pesticides may be chopped to appropriate lengths and sprayed onto plants for controlled release of insecticides, herbicides, and fungicides.

The invention is further defined by reference to the following examples, which are intended to illustrative and not limiting.

A Brabender Model 2003 was used as the extruder. All temperatures are in degrees celsius.

EXAMPLE 1

Pure Gellan Gum

| % | |
|---|---|
| 20 | Low acyl gellan |
| 80 | D. I. (de-ionized) water |

Process: The gellan was mixed with the water in a Hobart mixer until the damp mixture was uniform. The extruder was preheated to zone 1 80°, zone 2 100°. The extruder die was made of four No. 25 gauge needles. The mixture was fed into the extruder where it was heated and liquidized then pushed through the die into fibers. The die pressure was 350 psi.

Results: The liquid fibers gelled rapidly after exiting the die. The dry fibers had excellent strength.

EXAMPLE 2

Gellan Gum/Calcium

| % | |
|---|---|
| 20.0 | Low acyl gellan |
| 78.9 | D. I. water |
| 0.1 | $CaCl_2$ |

Process: The gellan was mixed with the water and calcium in a Hobart mixer until the damp mixture was uniform. Extrusion was an in Example 1.

Results: The liquid fibers gelled immediately upon exiting the die. The dry fibers had excellent strength but were more brittle than the fibers in Example 1.

EXAMPLE 3

Pure Gellan Gum

| % | |
|---|---|
| 15 | Native gellan |
| 85 | D. I. water |

Process: Extrusion was as in Example 1 except zone 2 was 110° and the die pressure was 450 psi.

Results: The liquid fibers gelled immediately upon existing the die. The dry fibers had excellent strength and were more flexible than in Examples 1 and 2.

EXAMPLE 4

Gellan Gum/Calcium

| % | |
|---|---|
| 15.0 | Native gellan |
| 84.9 | D. I. water |
| 0.1 | $CaCl_2$ |

Process: The gellan was mixed with the water and the calcium in a Hobart mixer until the damp mixture was uniform. Extrusion was as in Example 3.

Results: The liquid fibers gelled immediately upon exiting the die. The dry fibers had excellent strength but were only as flexible as in Example 1.

EXAMPLE 5

Pure Carrageenan

| % | |
|---|---|
| 25 | Iota-Carrageenan |
| 75 | D. I. water |

Process: Extrusion was as in Example 1 except zone 2 was 80° and the die pressure was 300 psi.

Results: The liquid fibers gelled immediately upon exiting the die. The wet gelled fibers were very elastic and had only moderate strength. The dry fibers were much weaker than the gellan gum fiber but were coherent.

EXAMPLE 6

Carrageenan/LBG

| % | |
|---|---|
| 16 | Iota-Carrageenan |
| 4 | Locust bean |
| 80 | D. I. water |

Process: The carrageenan and the LBG were dry blended together then mixed with the water in a Hobart mixer until the damp mixture was uniform. Extrusion was as in Example 1 except zone 2 was 90°.

Results: The liquid fibers gelled immediate upon exiting the die. The wet gelled fibers were elastic but less than in Example 5. The dry strength was better than in Example 5, but not as good as gellan gum.

EXAMPLE 7

Xanthan/LBG

| % | |
|---|---|
| 10 | Xanthan |
| 10 | Locust bean |
| 80 | D. I. water |

Process: The xanthan and the LBG were dry blended together then mixed with the water in a Hobart mixer until the damp mixture was uniform. Extrusion was as in Example 1 except zone 2 was 90° and the die pressure was 400 psi.

Results: The liquid fibers gelled immediately upon exiting the die. The wet gelled fibers were very elastic. The dry strength was high.

EXAMPLE 8

Gellan/Algin

| % | |
|---|---|
| 16 | Low acyl gellan |
| 4 | Sodium alginate |
| 80 | D. I. water |

Process: Same as Example 7, but zone 2 was 100° and and the die pressure was 350 psi.

Results: The results were the same as in Example 1.

EXAMPLE 9

Gellan/Algin Ca++ Bath

| % | |
|---|---|
| 16 | Low acyl gellan |
| 4 | Sodium alginate |
| 80 | D. I. water |

Process: Same as Example 8, but the wet gelled fibers were dipped into a 2.0% $CaCl_2$ bath for five minutes and then dried.

Results: The results were the same as Example 8 but the dry fiber were stiffer.

EXAMPLE 10

Gellan/Algin

| % | |
|---|---|
| 10 | Low acyl gellan |
| 10 | Sodium alginate |
| 80 | D. I. water |

Process: Same as Example 7, but zone 2 was 100° and the die pressure was 380 psi.

Results: The results were the same as Example 1 but the wet gelled fibers were slightly tacky. The dry fibers were the same as in Example 8.

EXAMPLE 11

Gellan/Algin

| % | |
|---|---|
| 10 | Low acyl gellan |
| 10 | Sodium alginate |

-continued

| % | |
|---|---|
| 80 | D. I. water |

Process: Same as Example 10, but the wet gelled fibers were dipped into a 2.0% $CaCl_2$ bath for five minutes and then dried.

Results: The results were the same as Example 10 but the dry fibers were stiffer.

EXAMPLE 12

Gellan/Algin

| % | |
|---|---|
| 5 | Low acyl gellan |
| 15 | Sodium alginate |
| 80 | D. I. water |

Process: Same as Example 7 but zone 2 was 100° and the die pressure was 420 psi.

Results: The results were the same as Example 10 but the wet gelled fibers were tacky. The dry fibers were the same as in Example 8.

EXAMPLE 13

Gellan/Algin Ca++ Bath

| % | |
|---|---|
| 5 | Low acyl gellan |
| 15 | Sodium alginate |
| 80 | D. I. water |

Process: Same as Example 12, but the wet gelled fibers were dipped into a 2.0% $CaCl_2$ bath for five minutes and then dried.

Results: The results were the same as in Example 12 but the dry fibers were stiffer.

EXAMPLE 14

Gellan/Algin

| % | |
|---|---|
| 16 | Native gellan |
| 4 | Sodium alginate |
| 80 | D. I. water |

Process: Same as Example 4 but zone 2 was 110° and the die pressure was 420 psi.

Results: The results were the same as in Example 4.

EXAMPLE 15

Gellan/Algin/Ca++ Bath

| % | |
|---|---|
| 16 | Native gellan |
| 4 | Sodium alginate |
| 80 | D. I. water |

Process: Same as Example 14, but the wet gelled fibers were dipped into a 2.0% $CaCl_2$ bath for five minutes and then dried.

Results: The results were the same as in Example 14 but the dry fibers were stiffer.

EXAMPLE 16

Gellan/Algin

| % | |
|---|---|
| 10 | Native gellan |
| 10 | Sodium alginate |
| 80 | D. I. water |

Process: Same as Example 14 but zone 2 was 110° and the die pressure was 470 psi.

Results: The results were the same as Example 4 but the wet gelled fibers were tacky. The dry fibers were the same as in Example 14.

EXAMPLE 17

Gellan/Algin/Ca++ Bath

| % | |
|---|---|
| 10 | Native gellan |
| 10 | Sodium alginate |
| 80 | D. I. water |

Process: Same as Example 16, but the wet gelled fibers were dipped into a 2.0% $CaCl_2$ bath for five minutes and then dried.

Results: The results were the same as in Example 15 but the dry fibers were stiffer.

EXAMPLE 18

Gellan/Algin

| % | |
|---|---|
| 5 | Native gellan |
| 15 | Sodium alginate |
| 80 | D. I. water |

Process: Same as Example 16 but zone 2 was 110° and the die pressure was 490 psi.

Results: The results were the same as Example 16 but the wet gelled fibers were tacky. The dry fibers were the same as in Example 14.

EXAMPLE 19

Gellan/Algin/Ca++ Bath

| % | |
|---|---|
| 5 | Native gellan |
| 15 | Sodium alginate |
| 80 | D. I. water |

Process: Same as Example 18, but the wet gelled fibers were dipped into a 2.0% $CaCl_2$ bath for five minutes and then dried.

Results: The results were the same as in Example 18 but the dry fibers were stiffer.

EXAMPLE 20

Gellan/Xanthan/LBG

| % | |
|---|---|
| 16 | Low acyl gellan |
| 2 | Xanthan |
| 2 | Locust bean |

-continued

| % | |
|---|---|
| 80 | D. I. water |

Process: Same as Example 1 but the die pressure was 380 psi.

Results: The results were the same as Example 1 but the wet gelled fibers were slightly more elastic. The dry fibers were the same as in Example 1.

EXAMPLE 21

Gellan/Xanthan/LBG

| % | |
|---|---|
| 16 | Native gellan |
| 2 | Xanthan |
| 2 | Locust bean |
| 80 | D. I. water |

Process: Same as Example 4 but the die pressure was 420 psi.

Results: The results were the same as in Example 4.

EXAMPLE 22

Gellan/Xanthan

| % | |
|---|---|
| 16 | Low acyl gellan |
| 4 | Xanthan |
| 80 | D. I. water |

Process: Same as Example 1.

Results: The results were the same as in Example 20.

EXAMPLE 23

Gellan/Xanthan

| % | |
|---|---|
| 16 | Native gellan |
| 4 | Xanthan |
| 80 | D. I. water |

Process: Same as Example 1.

Results: The results were the same as in Example 21.

EXAMPLE 24

Gellan/Xanthan/Calcium

| % | |
|---|---|
| 16.0 | Low acyl gellan |
| 2.0 | Xanthan |
| 79.9 | D. I. water |
| 0.1 | $CaCl_2$ |

Process: Same as Example 2.

Results: The results were the same as in Example 22 but the fibers were more brittle.

EXAMPLE 25

Gellan/Algin/Magnesium

| % | |
|---|---|
| 14.0 | Low acyl gellan |
| 6.0 | Sodium alginate |
| 0.1 | $MgCl_2.6H_2O$ |
| 76.4 | D. I. water |

Process: Same as Example 6.

Results: The results were the same as in Example 1 except that the fibers gelled faster.

What is claimed is:

1. A method for producing gum fibers containing magnesium which comprises:
   1) dispersing 10–30% gellan gum in water;
   2) heating the dispersion of step (1) to 80°–100° C. to dissolve the gum;
   3) extruding and cooling the heated dispersion of step (2) into an aqueous gelling bath comprising 0.2–5% magnesium salt; and
   4) forming gum fibers in the bath.

2. A method for producing gum fibers containing magnesium which comprises:
   1) dispersing about 2–30% gellan gum, and up to about 24% of one or more non-gelling gums, selected from the group consisting of algin, galactomannan, xanthan, pectin, tragacanth and arabic, in water, wherein the additive amount of gellan and non-gelling gum is about 10–30%;
   2) heating the dispersion of step (1) to 80°–100° C. to dissolve the gum;
   3) extruding and cooling the heated dispersion of step (2) into an aqueous gelling bath comprising 0.2–5% magnesium salt; and
   4) forming gum fibers in the bath.

* * * * *